US007637636B2

(12) United States Patent
Zheng et al.

(10) Patent No.: US 7,637,636 B2
(45) Date of Patent: Dec. 29, 2009

(54) LED LAMP

(75) Inventors: Shi-Song Zheng, Shenzhen (CN); Li He, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 25 days.

(21) Appl. No.: 12/013,376

(22) Filed: Jan. 11, 2008

(65) Prior Publication Data

US 2009/0116233 A1 May 7, 2009

(30) Foreign Application Priority Data

Nov. 2, 2007 (CN) ..... 2007 1 0124252

(51) Int. Cl.
*F21V 29/00* (2006.01)

(52) U.S. Cl. ..... 362/294; 362/373

(58) Field of Classification Search ..... 362/218, 362/264, 294, 345, 373, 800, 240
See application file for complete search history.

(56) References Cited

U.S. PATENT DOCUMENTS 5,890,794 A * 4/1999 Abtahi et al. ..... 362/294
6,525,668 B1 * 2/2003 Petrick ..... 340/815.45
7,014,337 B2 * 3/2006 Chen ..... 362/240
7,434,964 B1 * 10/2008 Zheng et al. ..... 362/294
7,513,653 B1 * 4/2009 Liu et al. ..... 362/294
2005/0174780 A1 * 8/2005 Park ..... 362/294
2007/0159828 A1 * 7/2007 Wang ..... 362/294
2007/0230172 A1 * 10/2007 Wang ..... 362/249
2007/0230184 A1 * 10/2007 Shuy ..... 362/294
2008/0002410 A1 * 1/2008 Burton et al. ..... 362/294
2008/0316755 A1 * 12/2008 Zheng et al. ..... 362/373

FOREIGN PATENT DOCUMENTS

CN 2934916 Y 8/2007

* cited by examiner

*Primary Examiner*—Jacob Y Choi
(74) *Attorney, Agent, or Firm*—Frank R. Niranjan

(57) ABSTRACT

An LED lamp includes a lamp base (10), a first heat sink (20) mounted on the lamp base, a plurality of second heat sinks (40) attached to a periphery of the first heat sink and a plurality of LED modules (30) respectively attached to the second heat sinks. The lamp base defines a plurality of vents (166) therein. The first heat sink includes a cylinder (22) at a center thereof. The cylinder has a through hole (25) defined therein, which communicates with the vents and cooperates with the vents to form an air passage communicating with ambient air. A thickness of each of the second heat sinks is gradually varied along a height direction of the each of the second heat sinks.

18 Claims, 4 Drawing Sheets

LED LAMP

BACKGROUND OF THE INVENTION

1. Field of the Invention

The present invention relates to an LED lamp, and particularly to an LED lamp applying heat dissipation structures for dissipating heat from LEDs of the LED lamp.

2. Description of Related Art

An LED lamp is a type of solid-state lighting that utilizes light-emitting diodes (LEDs) as a source of illumination. An LED is a device for transferring electricity to light by using a theory that, if a current is made to flow in a forward direction through a junction comprising two different semiconductors, electrons and cavities are coupled at the junction region to generate a light beam. The LED has an advantage that it is resistant to shock, and has an almost eternal lifetime under a specific condition; thus, the LED lamp is intended to be a cost-effective yet high quality replacement for incandescent and fluorescent lamps.

An LED lamp generally requires a plurality of LEDs, and most of the LEDs are driven at the same time, which results in a quick rise in temperature of the LED lamp. Since generally the LED lamps do not have heat dissipation devices with good heat dissipating efficiencies, operation of the conventional LED lamps has a problem of instability because of the rapid build up of heat. Consequently, the light from the LED lamp often flickers, which degrades the quality of the illumination. Furthermore, the LED lamp is used in a state of high temperature for a long time, whereby the life time thereof is consequently shortened.

Besides, the LEDs of the LED lamp are fixedly oriented at respectively predetermined directions. It is difficult to alter the predetermined directions of the LEDs to enable the LED lamp to be used in a different condition of requirement.

What is needed, therefore, is an LED lamp which has a heat dissipation structure with a great heat dissipating capability. Furthermore, the heat dissipation structure can be easily altered, whereby the LEDs of the LED lamp can be oriented toward different directions so that the LED lamp can be used in a different condition of requirement.

SUMMARY OF THE INVENTION

An LED lamp for lighting includes a lamp base, a first heat sink mounted on the lamp base, a plurality of second heat sinks attached to a periphery of the first heat sink and a plurality of LED modules respectively attached to outer walls the second heat sinks. The outer walls of the second heat sinks are slantwise in respective to a vertical direction, whereby light generated by the LED modules can be more intensively focused in a first direction when the second heat sinks are mounted to the first heat sink by a first orientation, or can be more intensively focused in a second direction when the second heat sinks are mounted to the first heat sink by a second orientation inverted from the first orientation. The lamp base defines a plurality of vents therein. The first heat sink includes a cylinder at a centre thereof. The cylinder has a through hole defined therein, which communicates with the vents and cooperates with the vents to form an air passage communicating with ambient air.

BRIEF DESCRIPTION OF THE DRAWINGS

Many aspects of the present LED lamp can be better understood with reference to the following drawings. The components in the drawings are not necessarily drawn to scale, the emphasis instead being placed upon clearly illustrating the principles of the present LED lamp. Moreover, in the drawings, like reference numerals designate corresponding parts throughout the several views.

DETAILED DESCRIPTION OF THE INVENTION

Figure 1:
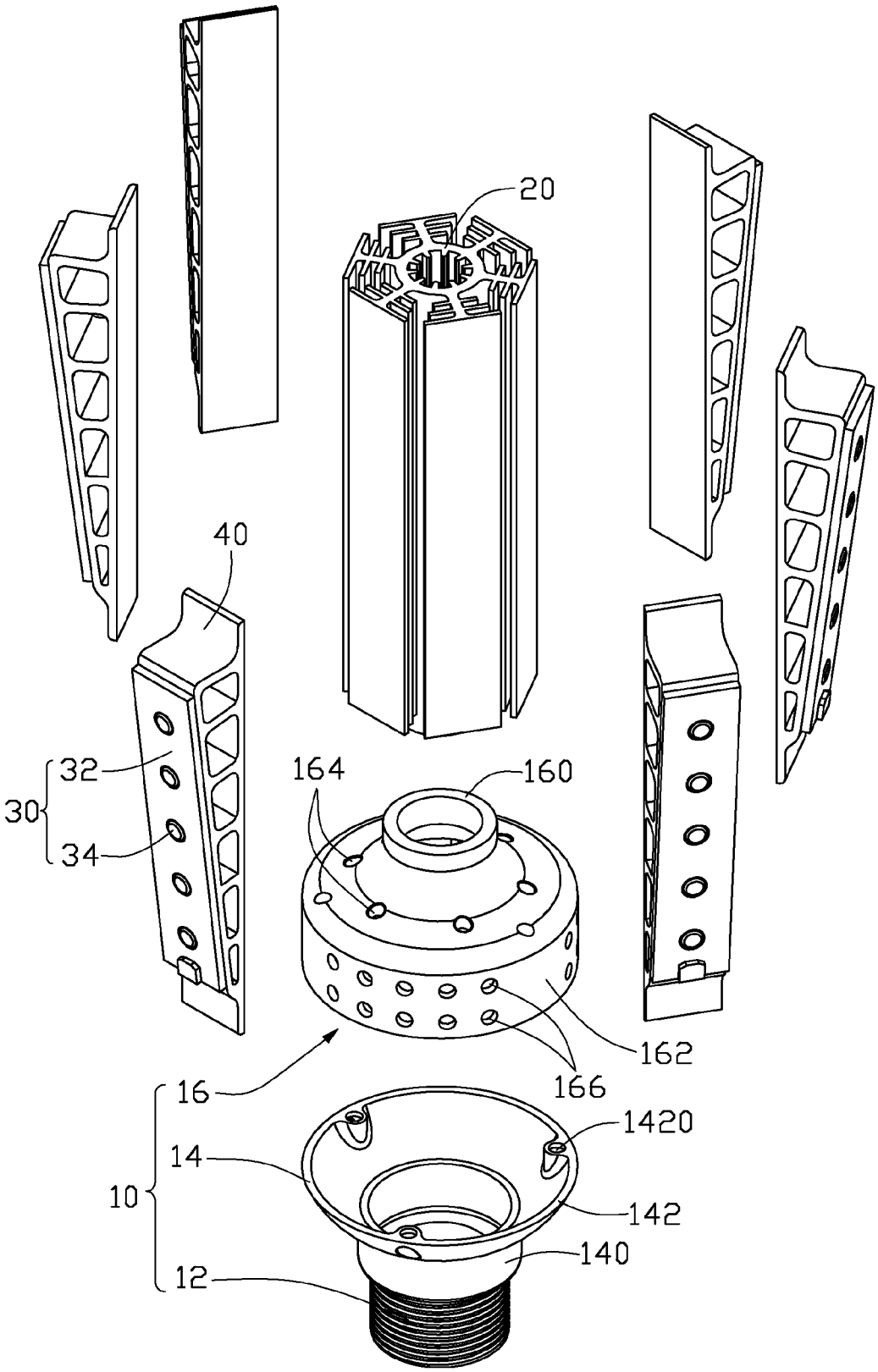
FIG. 1 is an isometric, exploded view of an LED lamp in accordance with a first preferred embodiment of the present invention.
Figure 2:
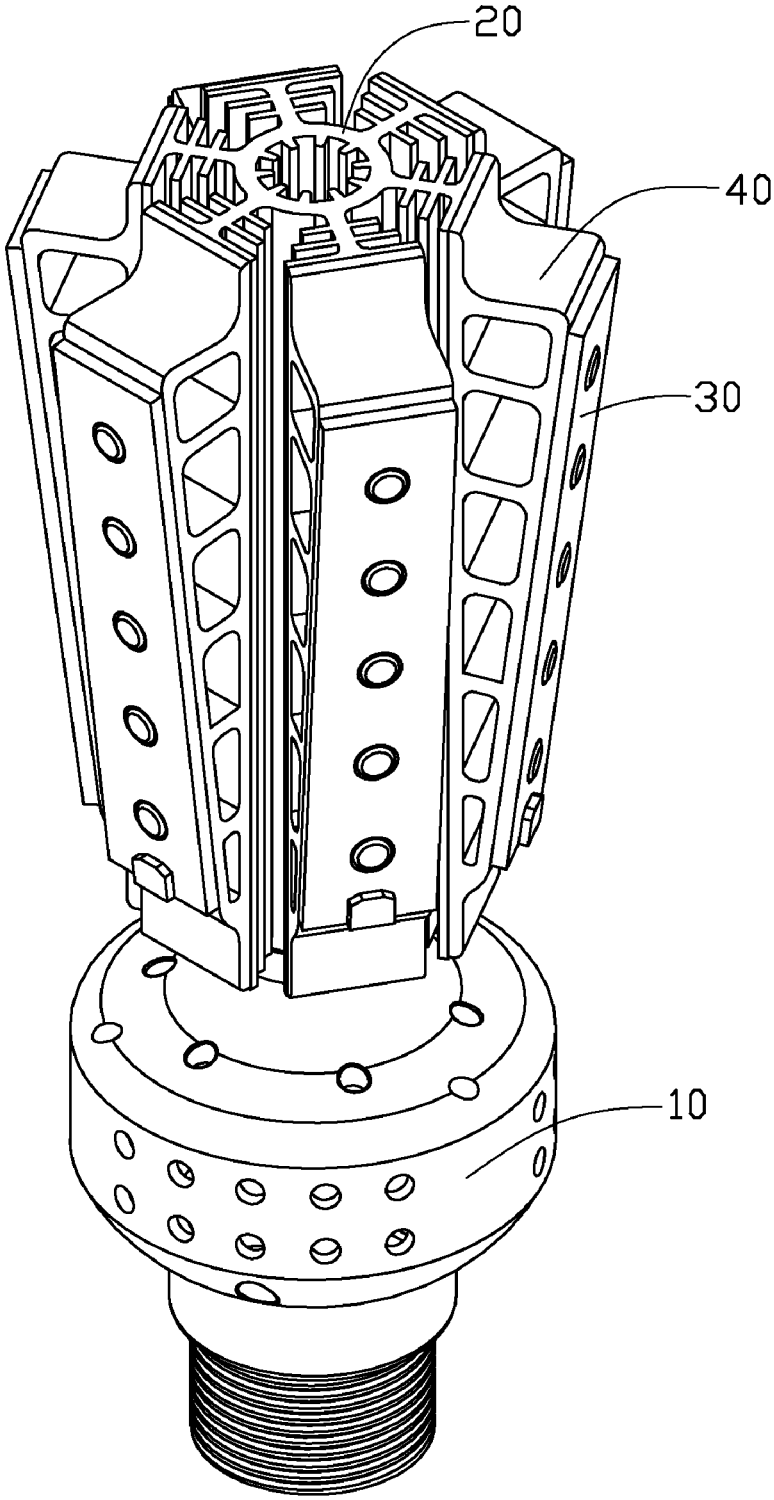
FIG. 2 is of an isometric, assembled view of the LED lamp of FIG. 1.

Referring to FIGS. 1-2, an LED lamp for a lighting purpose in accordance with a first preferred embodiment of the present invention is shown. The LED lamp comprises a lamp base 10, a first heat sink 20 mounted on the lamp base 10, a plurality of second heat sinks 40 attached to a periphery of the first heat sink 20 and a plurality of LED modules 30 thermally attached to the second heat sinks 40.

The lamp base 10 comprises a lamp holder 12, a first cover 14 connecting with the lamp holder 12 and a second cover 16 facing and engaging with the first cover 14. The lamp holder 12 has screw threads formed on a periphery thereof and has a standardized configuration for fitting in a standardized lamp socket (not shown). The first cover 14 comprises an annular joining portion 140 coupled with the lamp holder 12 and a first bowl-shaped body 142 extending upwardly from an upper edge of the joining portion 140. The first bowl-shaped body 142 has a caliber increasing upwardly. Three fixing orifices 1420 are evenly defined in an upper rim of the first bowl-shaped body 142. The three fixing orifices 1420 extend through the first bowl-shaped body 142 vertically for allowing screws (not shown) to extend therethrough to screw into the second cover 16.

The second cover 16 comprises an annular engaging portion 160 at a top portion thereof and a second bowl-shaped body 162 extending downwardly from a lower edge of the engaging portion 160. The engaging portion 160 has a smaller diameter than that of the joining portion 140 of the first cover 14 and engages with the first heat sink 20. An upper portion of the second bowl-shaped body 162 has a caliber increasing downwardly and defines a plurality of leading orifices 164 therein for allowing lead wires (not shown) to extend from an inner space (not labeled) of the lamp base 10 through the leading orifices 164 to electrically connect with the LED modules 30. A lower portion of the second bowl-shaped body 162 which has a constant caliber is substantially tube-shaped and symmetrically defines a plurality of vents 166 therein for allowing ambient air to flow into the inner space enclosed by the first and second covers 14,16 of the lamp base 10 and circulate in the LED lamp. Three engaging orifices (not shown) are symmetrically defined in a lower rim of the second bowl-shaped body 162. The three engaging orifices are used for engaging with the screws extending through the fixing orifices 1420 of the first cover 14 to couple the first cover 14 with the second cover 16. The first and second covers 14, 16 cooperatively form an enclosure (not labeled) defining the inner space therein. A rectifier (not shown) for the LED modules 30 can be accommodated in the inner space of the enclosure.

Figure 3:
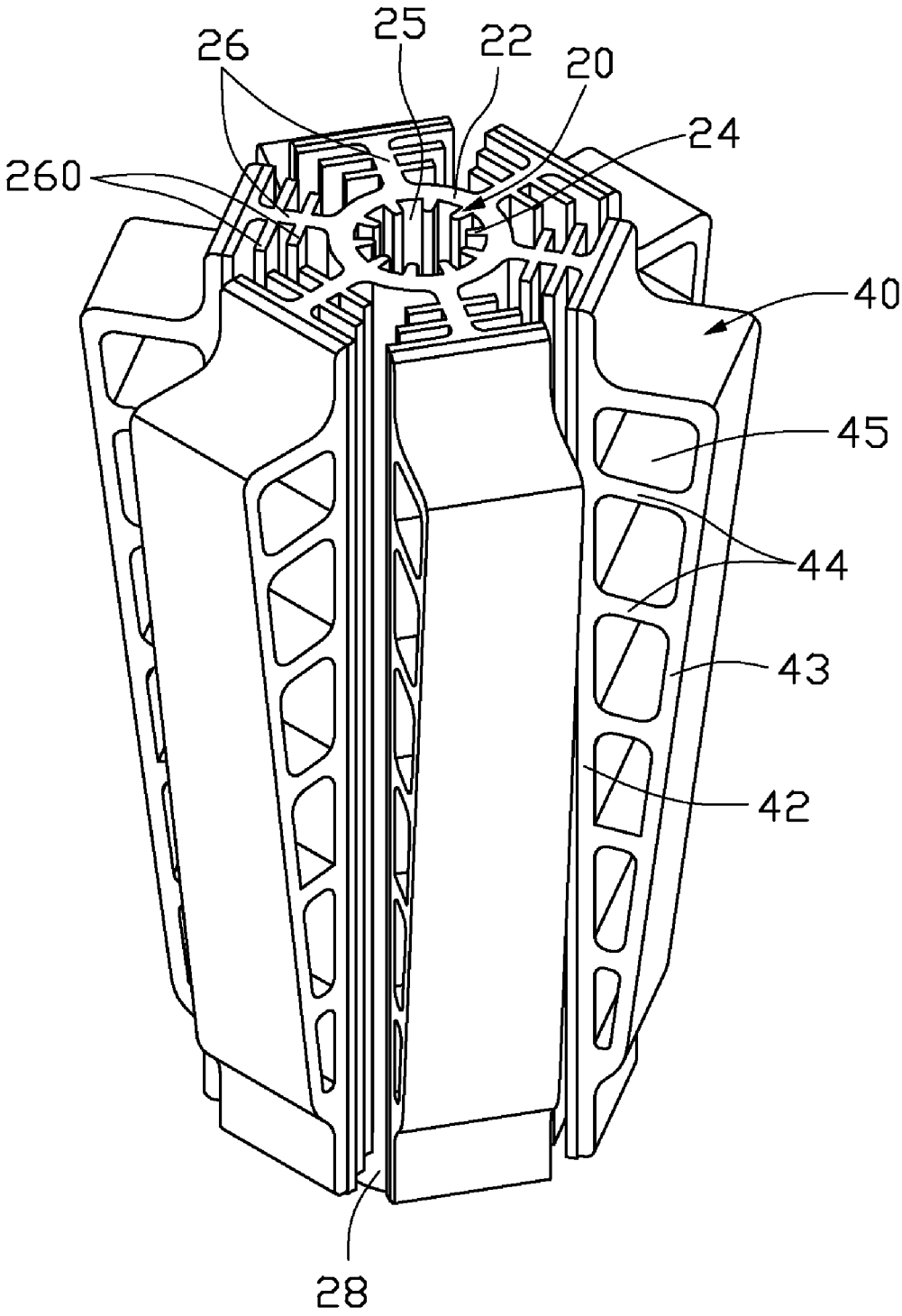
FIG. 3 is an isometric, assembled view of a first heat sink and second heat sinks of the LED lamp of FIG. 1.

Please also referring to FIG. 3, the first heat sink 20 is integrally made of a metal with a high heat conductivity such as aluminum, copper or an alloy thereof. The first heat sink 20 has a heat-conductive member at a centre thereof. In this embodiment, the heat-conductive member is an elongated cylinder 22 with a through hole 25 defined therein. The first heat sink 20 has a plurality of conducting arms 26 extending outwardly from an outer wall of the cylinder 22. The conducting arms 26 are identical to each other and centrosymmetric in respect to a central axis of the cylinder 22. An amount of the conducting arms 26 is identical to that of the second heat sinks 40 and the LED modules 30. In this embodiment, there are six conducting arms 26, six second heat sinks 40 and six LED modules 30. Understandably, the amount of the conducting arms 26, the second heat sinks 40 and the LED modules 30 can be changed. A plurality of first fins 260 extend perpendicularly from two opposite lateral sides of each of the conducting arms 26. The first fins 260 are increasing in length outwardly from the cylinder 22 to a distal end of the corresponding conducting arm 26. Each of the conducting arms 26 has a distal end terminating at an inner face of an outmost first fin 260 thereof. An outer face (not labeled) of each of the outmost first fins 260 is flat and used for thermally attaching to one of the second heat sinks 40. The cylinder 22 has a plurality of second fins 24 extending inwardly from an inner wall thereof. The second fins 24 are centrosymmetric in respect to the central axis of the cylinder 22 and each has a thickness decreasing inwardly. An annular fixing part 28 extends downwardly and vertically from a bottom edge of the cylinder 22 for connecting with the engaging portion 160 of the second cover 16 to mount the first heat sink 20 on the lamp base 10. The first heat sink 20 can be locked together with the lamp base 10 by means of threaded engagement with screw threads formed on both the fixing part 28 and the engaging portion 160.

Each of the second heat sinks 40 comprises a body portion 42, an inclined outer wall 43 and a plurality of connecting ribs 44 connecting the body portion 42 with the outer wall 43. The second heat sink 40 has a wedged-shaped configuration and a thickness of the second heat sink 40 is gradually increased upwardly. Specifically, the body portion 42 thermally attaches to the outmost first fin 260 of the first heat sink 20 and has a size substantially identical to that of the outmost first fin 260 of the first heat sink 20. The outer wall 43 extends upwardly and slantwise from a bottom portion of the body portion 42, with a distance defined therebetween increasing upwardly. The connecting ribs 44 have lengths which are increased upwardly. The connecting ribs 44 are spaced apart from each other and a plurality of channels 45 are defined between every two adjacent connecting ribs 44 for allowing air to flow therethrough. The channels 45 have different sizes.

The LED modules 30 each comprises an elongated printed circuit board 32 with a size substantially identical to that of the outer wall 43 of the second heat sink 40. A plurality of LED components 34 (five in this embodiment) are mounted in a line on each of the printed circuit boards 32 along a length thereof.

In assembly of the LED lamp, the screws pass through the fixing orifices 1420 of the first cover 14 of the lamp base 10 to screw into the second cover 16 of the lamp base 10; the first and second covers 14, 16 are thus assembled together. The first heat sink 20 is mounted on the second cover 16 of the lamp base 10 by the fixing part 28 at the bottom of the first heat sink 20 engaging with the engaging portion 160 of the second cover 16. The second heat sinks 40 are respectively attached to the outer faces of the outmost fins 260 of the first heat sink 20 by soldering. The LED modules 30 then are respectively mounted on the outer walls 43 of the second heat sinks 40 in a thermal conductive relationship therewith.

In use of the LED lamp, the inner space defined in the enclosure of the first and second covers 14,16 and the through hole 25 in the cylinder 22 of the heat sink 20 are communicated with each other and cooperatively define an air passage in the LED lamp. Ambient air can flow into the air passage in the LED lamp through the vents 166 of the second cover 16 of the lamp base 10 and exit the air passage from a top of the cylinder 22 of the heat sink 20. Alternatively, ambient air can enter the air passage through the top of the cylinder 22 and exit therefrom from the vents 166. An air circulation is thereby implemented wherein the air circulates between the air passage in the LED lamp and ambient space around the LED lamp. The ambient air can also flow through the first fins 260 of the first heat sink 20 and the channels 45 defined in the second heat sinks 40. When the LED modules 30 are activated, heat generated by the LED components 34 is absorbed by the second heat sinks 40 and then evenly distributed to the whole first heat sink 20. The heat of the first heat sink 20 and the second heat sinks 40 is finally dissipated to ambient air.

As the thickness of each of the second heat sinks 40 is increased upwardly, upper portions of the LED modules 30 mounted on the outer walls 43 of the second heat sinks 40 face outwardly and downwardly; the light emitted from the LED modules 30 thereby can project both outwardly and downwardly. Therefore, light generated by the LED components 34 can be more intensively focused in a downward direction simultaneously with a large coverage area.

Figure 4:
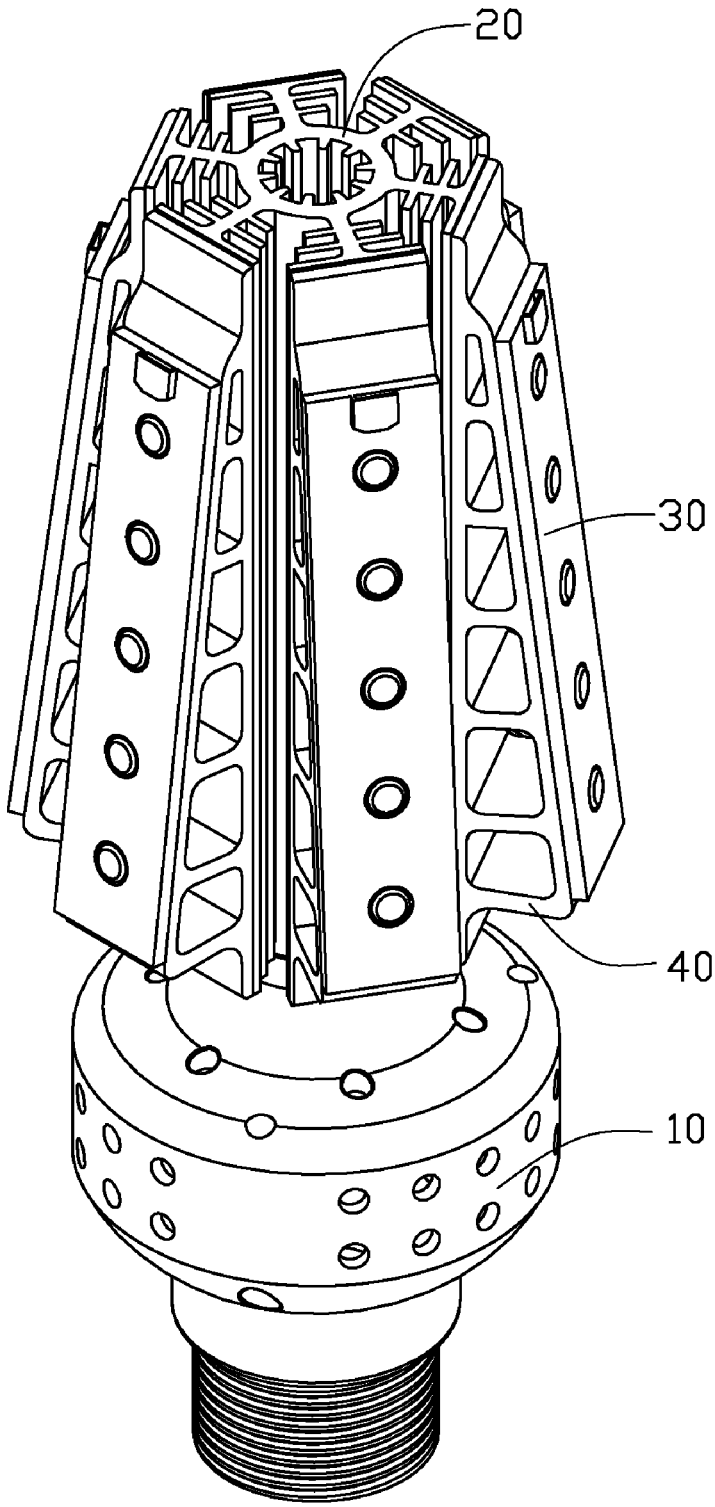
FIG. 4 is an isometric, assembled view of an LED lamp in accordance with a second preferred embodiment of the present invention.

FIGS. 4 shows an LED lamp according to a second embodiment of the present invention. Compared with the first embodiment, the second embodiment is almost the same with the first embodiment, except a location of the second heat sinks 40. The second heat sinks 40 of the second embodiment are inverted from the second heat sinks 40 of the first embodiment. In other words, a thickness of each of the second heat sinks 40*a* is increased downwardly. Therefore, light generated by the LED components 34 of the LED lamp in accordance with this second embodiment can be more intensively focused in an upward direction simultaneously with a large coverage area.

It is believed that the present invention and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp comprising:

a lamp base defining a plurality of vents therein;

a first heat sink mounted on the lamp base and comprising a cylinder at a centre thereof, the cylinder having a through hole defined therein, which communicates with the vents of the lamp base and cooperates with the vents to form an air passage communicating with ambient air;

a plurality of second heat sinks attached to a periphery of the first heat sink, a thickness of each of the second heat sinks varying along a length direction of the each of the second heat sinks; and a plurality of LED modules attached to the second heat sinks, respectively;

wherein the each of the second heat sinks comprises a body portion attached to the first heat sink, an outer wall extending slantwise from an end portion of the body portion for a corresponding LED module mounting thereon, a plurality of connecting ribs connecting the body portion with the outer wall, and a plurality of channels with different sizes each defined between every two adjacent connecting ribs for allowing air to flow therethrough.

2. The LED lamp of claim 1, wherein the outer wall extends upwardly from a bottom portion of the body portion.

3. The LED lamp of claim 1, wherein the outer wall extends downwardly from an upper portion of the body portion.

4. The LED lamp of claim 3, wherein each of the LED modules comprises a printed circuit board and a plurality of LED components mounted thereon, and the printed circuit boards of the LED modules are attached to the outer walls of the second heat sinks, respectively.

5. The LED lamp of claim 1, wherein the first heat sink has a plurality of conducting arms extending outwardly from an outer wall of the cylinder, and a plurality of first fins are formed at two lateral sides of each of the conducting arms.

6. The LED lamp of claim 5, wherein the first fins of the each of the conducting arms are perpendicular to the each of the conducting arms, and increase in length outwardly from the cylinder to a distal end of the each of the conducting arms.

7. The LED lamp of claim 6, wherein the distal end of each of the conducting arms terminates at an inner face of an outmost one of the first fins of the each of the conducting arms, and an outer face of the outmost one of the first fins is flattened on which a corresponding second heat sink is mounted.

8. The LED lamp of claim 1, wherein the first heat sink has a plurality of second fins extending inwardly from an inner wall of the cylinder.

9. The LED lamp of claim 8, wherein a thickness of each of the second fins decreases inwardly.

10. The LED lamp of claim 1, wherein the lamp base comprises a lamp holder, a first cover connecting with the lamp holder and a second cover facing and engaging with the first cover, the lamp holder being adapted for engaging in a lamp socket.

11. The LED lamp of claim 10, wherein the first and second covers cooperatively form an enclosure defining an inner space therein, the vents being defined in a middle of the enclosure, the inner space and the vents communicating with the through hole of the first heat sink.

12. The LED lamp of claim 10, wherein the first heat sink has a fixing part extending downwardly from a bottom of the cylinder thereof, the second cover forms an annular engaging portion at a top thereof for engaging with the fixing part.

13. An LED lamp comprising:

a base having a lamp holder adapted for connecting with a lamp socket, an inner space and a plurality of vents communicating the inner space with ambient air;

a first heat sink mounted on the base;

a plurality of second heat sinks each having a body portion mounted on the first heat sink, the each second heat sink being formed with an outer wall, a distance between the outer wall and the body portion being varied along a length of the each second heat sink; and a plurality of LED modules mounted on the outer walls of the second heat sinks and thermally connecting therewith;

wherein the second heat sink each comprise a plurality of connecting ribs connecting the body portion with the outer wall, and define a plurality of channels each between every two adjacent connecting ribs for allowing air to flow therethrough.

14. The LED lamp of claim 13, wherein the first heat sink has a cylindrical body defining a hole communicating with the inner space of the base and the first heat sink has a plurality of fins surrounding the cylindrical body.

15. The LED lamp of claim 14, wherein the body portions of the second heat sinks are mounted on outermost ones of the fins of the first heat sink.

16. An LED lamp comprising:

a first heat sink having a central cylinder and a plurality of first fins around the central cylinder;

a plurality of second heat sinks attached to the first fins, respectively, wherein each of the second heat sinks has a body portion attached to the first fins, a slantwise outer wall extending from an end portion of the body portion, a plurality of connecting ribs connecting the body portion with the outer wall, and a plurality of channels with different sizes each defined between every two adjacent connecting ribs for allowing air to flow therethrough;

a plurality of LED modules each being attached to a corresponding slantwise outer wall; and a lamp base secured to a bottom of the first heat sink, adapted for mounting the LED lamp to a lamp socket.

17. The LED lamp of claim 16, wherein a thickness of the each of the second heat sinks is gradually increased along a bottom-to-top direction whereby light generated by the LED modules is more intensively focused in a downward direction.

18. The LED lamp of claim 16, wherein a thickness of the each of the second heat sinks is gradually increased along a top-to-bottom direction whereby light generated by the LED modules can be more intensively focused in an upward direction.

* * * * *